US007066779B2

(12) United States Patent
Willinger

(10) Patent No.: US 7,066,779 B2
(45) Date of Patent: Jun. 27, 2006

(54) MOUNTING ARRANGEMENT FOR SQUEAKERS

(75) Inventor: Jon Willinger, Tenafly, NJ (US)

(73) Assignee: JW Pet Company, Teterboro, NJ (US)

( * ) Notice: Subject to any disclaimer, the term of this patent is extended or adjusted under 35 U.S.C. 154(b) by 138 days.

(21) Appl. No.: 10/889,962

(22) Filed: Jul. 13, 2004

(65) Prior Publication Data

US 2006/0014469 A1 Jan. 19, 2006

(51) Int. Cl.
*A63H 3/31* (2006.01)
*A01K 29/00* (2006.01)

(52) U.S. Cl. ..... 446/188; 119/707

(58) Field of Classification Search ..... 446/184, 446/183, 188; 119/707, 709, 711
See application file for complete search history.

(56) References Cited

U.S. PATENT DOCUMENTS

| | | | | | |
|---|---|---|---|---|---|
| 754,148 | A | | 3/1904 | Kuhlemann | |
| 1,187,838 | A | | 6/1916 | Hughes | |
| 1,612,651 | A | * | 12/1926 | Roberts | 156/61 |
| 1,668,785 | A | | 5/1928 | Smart | |
| 2,631,407 | A | * | 3/1953 | Rempel | 446/185 |
| 3,075,317 | A | | 1/1963 | Craft | |
| 3,702,038 | A | | 11/1972 | Hakim | |
| RE29,050 | E | | 11/1976 | Hakim | |
| 4,253,254 | A | * | 3/1981 | Gill | 36/139 |
| 4,506,468 | A | * | 3/1985 | Willhite | 43/17 |
| 4,779,344 | A | * | 10/1988 | Panisch | 30/326 |
| 5,113,784 | A | * | 5/1992 | Forselius | 116/137 R |
| 5,267,885 | A | * | 12/1993 | Niskern et al. | 446/88 |
| 6,112,703 | A | * | 9/2000 | Handelsman | 446/221 |
| 6,216,640 | B1 | * | 4/2001 | Zelinger | 119/707 |
| 6,413,139 | B1 | * | 7/2002 | Douglas | 446/204 |
| 6,609,944 | B1 | * | 8/2003 | Viola | 446/409 |
| 2001/0008125 | A1 | * | 7/2001 | Mann | 119/709 |
| 2002/0102912 | A1 | * | 8/2002 | Duval | 446/486 |

* cited by examiner

*Primary Examiner*—John A. Ricci
(74) *Attorney, Agent, or Firm*—Katten Muchin Rosenman LLP

(57) ABSTRACT

A method of mounting a squeaker into a hard rubber ball toy. A separate holder or sleeve is provided that retains a squeaker and forms the noise producing element to be inserted into the rubber toy. The sleeve has a recessed area that tightly mates with an opening in the rubber toy and also includes a bonding surface to secure the sleeve to the toy. The sleeve could also be formed with fin members that extend orthogonally from a distal end of the sleeve. The total width of the sleeve and the associated fin members is such that it complies with consumer product safety requirements.

18 Claims, 5 Drawing Sheets

MOUNTING ARRANGEMENT FOR SQUEAKERS

BACKGROUND OF THE INVENTION

1. Field of Invention

The present invention relates generally to the field of toys. More specifically, the present invention is related to a toy including a squeaker and method of mounting the squeaker into the toy.

2. Discussion of Prior Art

Generally, inserting a noise producing element into a figure or ball toy is well known. U.S. Pat. Nos. 754,148, 1,187,838, 1,668,785, RE29050, 3,075,317 and 3,702,038 show such devices.

As far as mounting arrangements go, in the case of vinyl material, as shown in FIG. 1*a* and FIG. 1*b*, the mounting of the squeaker mechanism into a toy is commonly done by molding an opening into the material. A common fitting is inserted into this opening. When bonded this fitting creates a slight whistling sound which could stand alone as a noise element. A barbed squeaker can then be forced into the fitting for a true squeak sound. And for latex material, as shown in FIG. 1*c*, a ribbed mound of material is created with a rough through-hole into which a barbed squeaker is inserted.

The prior art fails to provide squeakers utilizing a separate holder for gluing to a rubber toy. Also, none of the prior art squeakers have the present invention method for complying with child safety standards.

Whatever the precise merits, features, and advantages of the above cited references, none of them achieves or fulfills the purposes of the present invention.

SUMMARY OF THE INVENTION

The present invention includes a mounting arrangement for a squeaker into a rubber ball toy. The squeaker mechanism is trapped within a polystyrene or rubber sleeve to form a noise producing element. The sleeve has a recessed area that tightly mates with an opening in the rubber toy and also includes a bonding surface to secure the sleeve to the toy.

In an alternative embodiment, the sleeve also has fin members that extend orthogonally from a distal end of the sleeve. The total width of the sleeve and the associated fin members is such that it complies with consumer product safety requirements.

DESCRIPTION OF THE PREFERRED EMBODIMENTS

Figure 1A:
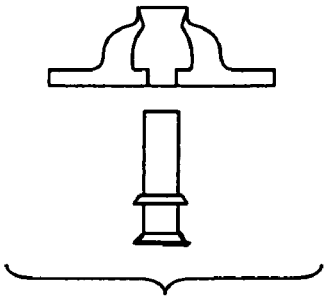
FIG. 1A PRIOR ART
FIG. 1*a* illustrates a prior art common fitting inserted into an opening molded into the vinyl
Figure 1B:
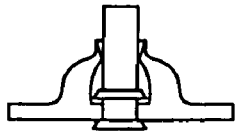
FIG. 1B PRIOR ART
FIG. 1*b* illustrates a prior art method of inserting squeaker into a common fitting
Figure 1C:
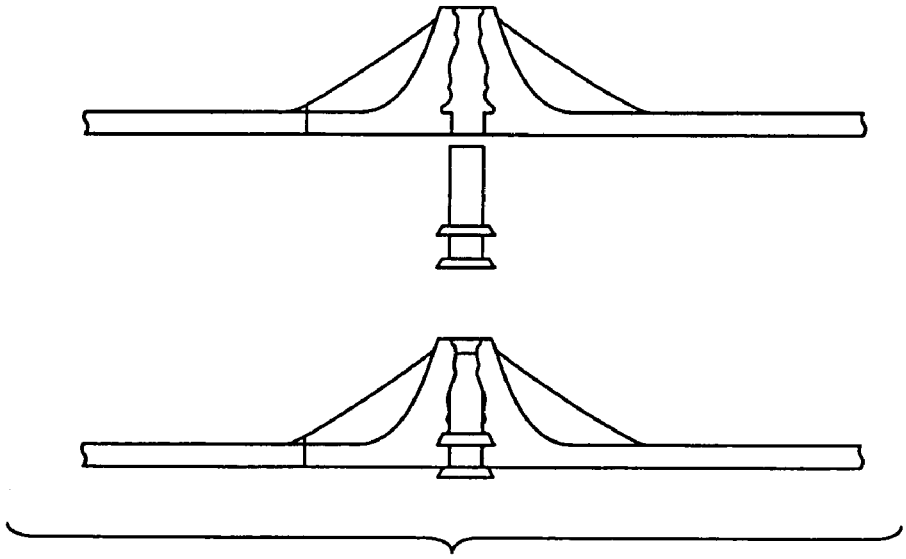
FIG. 1C PRIOR ART
FIG. 1*c* illustrates a prior art method of inserting squeaker into a rough through-hole

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

Figure 2A:
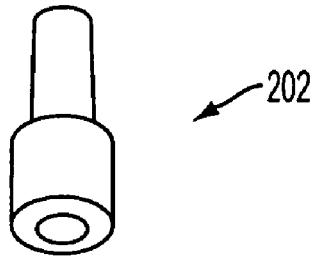
FIG. 2*a* illustrates a typical squeaker mechanism
Figure 2B:
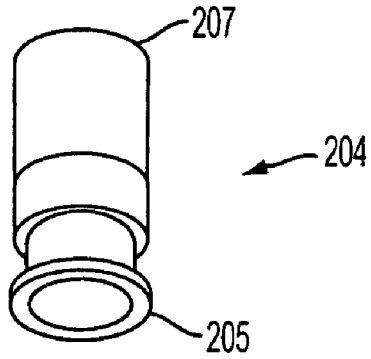
FIG. 2*b* illustrates a rubber sleeve to hold squeaker mechanism
Figure 2C:
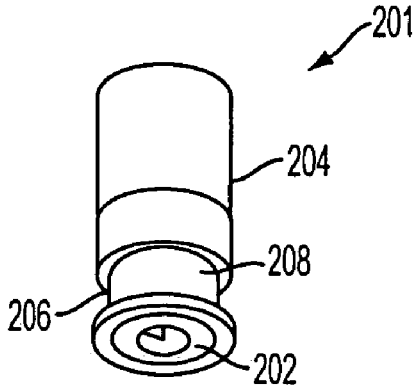
FIG. 2*c* illustrates squeaker mechanism retained in a sleeve and the rubber sleeve including a gluing surface

FIG. 2*a* shows a typical squeaker mechanism 202. According to a preferred embodiment, FIG. 2*b* shows rubber sleeve 204 with proximate and distal ends 205, 207 respectively. Noise producing element 201 as shown in FIG. 2*c*, is formed by engaging squeaker 202 with sleeve 204 such that squeaker 202 is retained within sleeve 204. The squeaker made from oliphanic material such as polypropylene or polyethylene, is placed into a sleeve that is styrenic and therefore provides a better bonding surface than the squeaker by itself.

Figure 3:
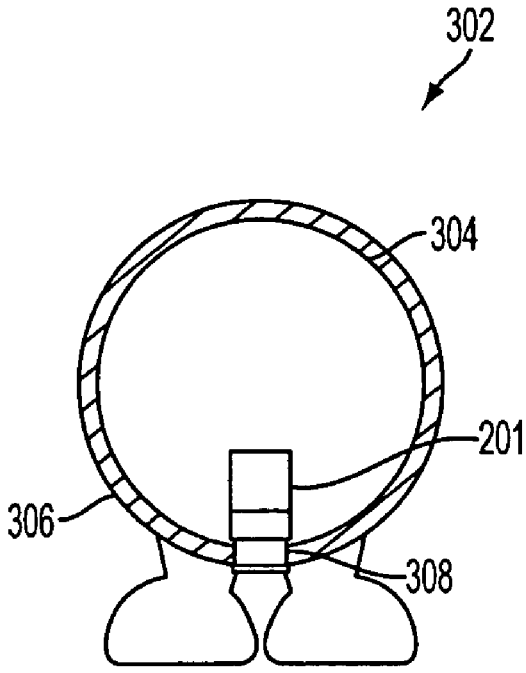
FIG. 3 illustrates mounting arrangement of squeaker in rubber ball

Referring now to FIG. 3, rubber toy 302 is fashioned of thick-walled heavy-duty rubber. The toy is formed with a hollow body 304 and an outer shell 306. The outer shell is, for example, 2" in diameter. The toy comprises an opening 308 through which the squeaker trapped in a rubber sleeve is inserted. Going back to FIG. 2*c*, the rubber sleeve is utilized as a separate holder for the squeaker and is provided with a bonding surface 208 that aids in the securing of the sleeve to the toy. The sleeve has recessed area 206 that tightly mates with opening 308 in the rubber toy and is bonded to the toy with cyanoacrylate. Please note that functionally equivalent squeaker materials, sleeve materials and bonding agents may be used without departing from the scope of the present invention.

Figure 4A:
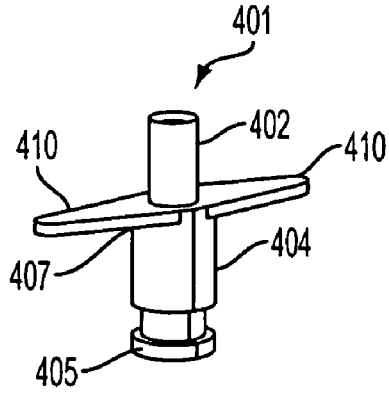
FIG. 4*a* illustrates a squeaker mechanism retained in a polystyrene sleeve
Figure 4B:
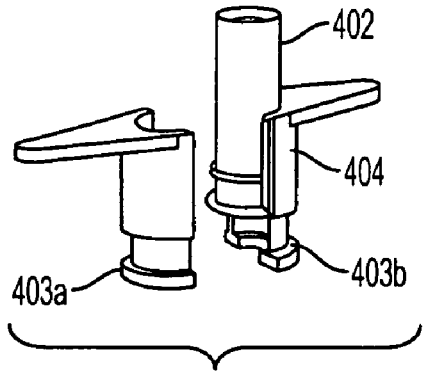
FIG. 4*b* illustrates a sleeve composed of two half shells and extending fins
Figure 4C:
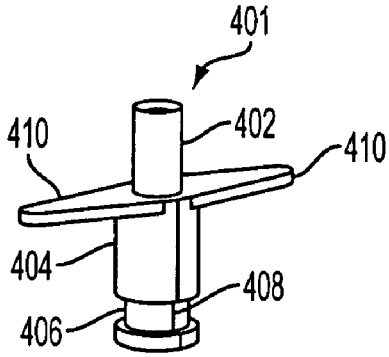
FIG. 4*c* illustrates a sleeve including a gluing surface

FIGS. 4*a*, 4*b*, 4*c* illustrate a second embodiment of the present invention. FIG. 4*a* shows squeaker 402 retained in polystyrene sleeve 404, with proximate and distal ends 405, 407 respectively, forming noise producing element 401. Sleeve 404 as shown in FIG. 4*b* is composed of two half shells 403*a*, 403*b* to be secured together.

In order to pass the Consumer Product Safety Commission standard for small children, the sleeve size of the present invention must not fall into a 1¼ inch aperture. Therefore to meet the safety ratings, preferably by a ½" diameter, sleeve 404 also includes integral extended members or fins 410 which are orthogonal to squeaker 402 to expand the total width of the sleeve. Please note that fins 410, in an alternative embodiment, may follow the curvature of the inner surface of the small toy.

Figure 5:
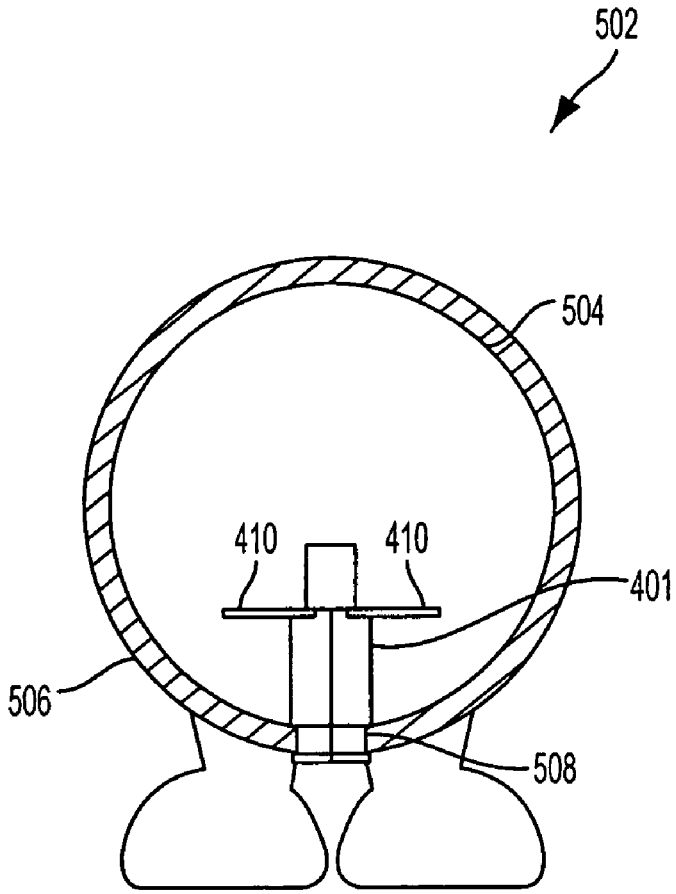
FIG. 5 illustrates mounting arrangement of squeaker in a rubber ball

Referring to FIG. 5, rubber toy 502 is similar in structure to rubber toy 302 of FIG. 3. The toy is formed with a hollow body 504 and outer shell 506. The outer shell is, for example, 3" in diameter. Sleeve 404 acts as a better bonding surface than squeaker 402. As shown in FIG. 4*c*, recessed area 406 integral to the sleeve mates with an opening 508 in the rubber toy. Sleeve 404 including bonding surface 408 secures the sleeve to the rubber toy with cyanoacrylate. Please note that a bigger sized squeaker (with sleeve) could be mounted into a correspondingly bigger toy in a similar manner so as to still provide for the requirements of consumer product safety rating as described above.

CONCLUSION

A system and method has been shown in the above embodiments for the effective implementation of mounting arrangement for squeakers. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by size, materials, or specific manufacturing techniques.

The invention claimed is:

1. A noise producing toy structure for a pet toy, the structure comprising:

a rubber outer shell defining at least a portion of the pet toy;

an opening in the rubber outer shell;

a squeaker for making noise, a sleeve fitted over the squeaker for providing a better bonding with the rubber outer shell than the squeaker, the squeaker being retained in the sleeve, the sleeve comprising proximate and distal ends secured in the opening;

a circumferential recess in the sleeve near the proximate end, the recess being sized to substantially mate tightly with the rubber outer shell at the opening when the sleeve is fitted to the squeaker so that a thickness of the rubber outer shell is wholly received in the recess.

2. A noise producing toy structure, according to claim 1, wherein said sleeve is made of styrenic material.

3. A noise producing toy structure, according to claim 1, wherein said sleeve includes bonding surface to secure said sleeve to said toy.

4. A noise producing toy structure, according to claim 1, wherein said sleeve is composed of two half shells to be secured together.

5. A noise producing toy structure, according to claim 1, wherein said sleeve includes a plurality of fin members extending orthogonally from said distal end.

6. A noise producing toy structure, according to claim 5, wherein a total width of said sleeve and associated fin members meets consumer product safety requirements.

7. A noise producing toy structure, according to claim 6, wherein said total width is equal to or greater than ½" in excess of said consumer product safety requirements.

8. A noise producing toy structure, according to claim 5, wherein said fin members are shaped to follow the curvature of an inner surface of said toy structure.

9. The noise producing toy structure of claim 1 further comprising cyanoacrylate applied to the recess for bonding the sleeve.

10. A method of mounting a squeaker in a pet toy, a rubber outer shell defining at least a portion of the pet toy, the rubber outer shell having an opening for receiving the squeaker, said method comprising the steps of:

(a) fitting a sleeve over the squeaker, the sleeve comprising proximate and distal ends and having a recess in the sleeve near the proximate end, (b) tightly mating the recess with the rubber outer shell in the opening of the rubber outer shell, the recess being sized to substantially mate tightly with the rubber outer shell at the opening when the sleeve is fitted to the squeaker;

(c) bonding the recess to the rubber outer shell.

11. A method of mounting a squeaker in a pet toy, according to claim 10, wherein step (c) uses cyanoacrylate.

12. A noise producing mechanism retained in a hollow pet toy body, the hollow body having a rubber outer shell defining at least a portion of the hollow body, the rubber shell having an opening for inserting the noise producing mechanism, the noise producing mechanism comprising:

a squeaker for making noise, a sleeve fitted over the squeaker for providing a better bonding with the rubber outer shell than the squeaker, the squeaker being retained in the sleeve, the sleeve comprising proximate and distal ends secured in the opening;

a recess in the sleeve near the proximate end, the recess being sized to substantially mate tightly with the rubber outer shell at the opening when the sleeve is fitted to the squeaker so that a thickness of the rubber outer shell is wholly received in the recess.

13. A noise producing mechanism retained in a hollow body, according to claim 12, wherein said sleeve includes fin members extending orthogonally from a distal end of said sleeve.

14. A noise producing mechanism retained in a hollow body, according to claim 13, wherein said fin members are shaped to follow the curvature of an inner surface of said hollow body.

15. A noise producing mechanism retained in a hollow body, according to claim 12, wherein said sleeve is made of styrenic material.

16. A noise producing mechanism retained in a hollow body, according to claim 12, wherein said hollow body is a rubber ball.

17. A noise producing mechanism retained in a hollow body, according to 12, wherein said hollow body is a rubber squeeze figure toy.

18. A noise producing mechanism retained in a hollow body, according to claim 12, wherein said hollow body is a pet toy.

* * * * *